United States Patent [19]

Williams

[11] Patent Number: 4,577,579

[45] Date of Patent: Mar. 25, 1986

[54] HYDROFOIL SEAL

[75] Inventor: John W. Williams, Bellevue, Wash.

[73] Assignee: The Boeing Company, Seattle, Wash.

[21] Appl. No.: 650,251

[22] Filed: Sep. 13, 1984

[51] Int. Cl.[4] ..... B63B 1/24

[52] U.S. Cl. ..... 114/274; 114/126; 114/167

[58] Field of Search ..... 114/162, 280, 126, 167, 114/274–282; 244/129.1, 215

[56] References Cited

U.S. PATENT DOCUMENTS

| | | | |
|---|---|---|---|
| 2,333,482 | 11/1943 | Littman | 244/99 |
| 2,542,792 | 2/1951 | Bennett et al. | 244/42 |
| 2,561,253 | 7/1951 | Wells-Coates | 114/103 X |
| 2,773,467 | 12/1956 | Bailey | 114/66.5 |
| 3,112,089 | 11/1963 | Dornier | 244/42 |
| 3,129,907 | 4/1964 | Dornier et al. | 244/42 |
| 3,270,699 | 9/1966 | Bush | 114/66.5 |
| 4,096,817 | 6/1978 | Bordat | 114/280 |
| 4,230,295 | 10/1980 | Eppler | 244/213 |
| 4,290,612 | 9/1981 | Stevens | 277/81 |

FOREIGN PATENT DOCUMENTS

| | | | |
|---|---|---|---|
| 386926 | 12/1923 | Fed. Rep. of Germany . | |
| 405849 | 1/1910 | France . | |
| 473912 | 2/1915 | France . | |
| 524814 | 9/1921 | France . | |
| 553134 | 5/1923 | France . | |
| 1409241 | 12/1965 | France | 114/167 |
| 23987 | of 1911 | United Kingdom . | |

*Primary Examiner*—Sherman D. Basinger

*Attorney, Agent, or Firm*—Christensen, O'Connor, Johnson & Kindness

[57] ABSTRACT

Disclosed is apparatus for sealing the surface spaces between and along the leading portion of a hydrofoil (16) and its movable flap (18). The apparatus includes an upper seal member (44) and a lower seal member (46) that are joined together by a spring-biased retention assembly (53). The seal members (44, 46) are joined at one edge (51) to the trailing edge of the leading portion of a hydrofoil. The trailing edges (45) of the seal members are maintained in continuous slidable contact with the leading edge (37) of the hydrofoil flap (18).

9 Claims, 6 Drawing Figures

10
12
14
16
18
18
18
38
38
43
44
A
A
B
B
B
B
2
2
5,6
5,6

HYDROFOIL SEAL

BACKGROUND OF THE INVENTION

This invention relates to the design of hydrofoils and, more particularly, to apparatus for spanning and sealing the gap between the main (or "leading") portion of a hydrofoil and a rearwardly extending, movable flap.

Hydrofoil craft design generally features a hull having downwardly depending struts attached thereto. Hydrofoils are fixed to the lowest ends of the struts and extend substantially orthogonal to them. The hydrofoil itself generally consists of a leading portion and a trailing flap. The leading portion is contoured to provide hydrodynamic lift to the hydrofoil craft as it moves through the water. The flaps, like ailerons of an aircraft wing, are pivotally attached to the trailing edge of the hydrofoil's leading portion and when actuated, control the attitude of the craft as it moves through the water. The flap's leading edge, that is, the portion proximal to the trailing edge of the leading portion of the hydrofoil, is smoothly rounded. The upper and lower surfaces of the flap gradually converge to meet at the flap's trailing edge.

For optimal hydrodynamic performance, it is desirable to provide continuity between the upper and lower surfaces of the leading portion of the hydrofoil and the corresponding upper and lower surfaces of the trailing flap. In this past, the upper and lower surfaces of the leading portion of the hydrofoil were extended to meet in slidable contact with the leading portion of the flap. These surface extensions had to be precisely machined in order to obtain the required hydrodynamic fit, while allowing the necessary operating clearances so that the leading edge of the flap could smoothly turn about the hinge without any binding interaction or undesirably large gaps between the flap and the extended surfaces. In addition to the extensive machining requirements of these surface extensions, the surfaces of the flap also had to be carefully machined to remove any distortions or irregularities that could cause binding as the flap surfaces slide against the surface In fabricating the conventional hydrofoil and flap, it is important that the axis of rotation of the hinge be located equidistantly from the upper and lower surfaces of the hydrofoil. Thus, for example, if the hinge was improperly mounted so that its axis of rotation was too close to the upper surface of the hydrofoil, rotation of the symmetrically curved leading portions of the flap about the misaligned axis of rotation would create a camming effect, i.e., causing the leading edge of the hydrofoil flap to be forced up against the upper surface extension instead of smoothly sliding against it. Furthermore, even if the axis of rotation of the hinge is properly positioned, another fabrication problem arises in attempting to ensure that the flap is mounted so that the geometric center of its leading portion is aligned with the axis of rotation of the hinge. If the flap is mounted to the hinge slightly off center, the undesirable camming effect will occur.

SUMMARY OF THE INVENTION

This invention provides an apparatus for spanning and sealing the gap between the leading portion of the hydrofoil and its trailing hydrofoil flap while alleviating the aforementioned problems. The apparatus comprises an upper seal member spanning the space between the upper surface of the leading portion of the hydrofoil and the upper surface of the flap; a lower seal member spanning the space between the lower surface of the leading portion of the hydrofoil and the lower surface of the flap; and a seal retention assembly for ensuring continuous contact between the upper seal member and the upper surface of the hydrofoil flap and between the lower seal member and the lower surface of the hydrofoil flap.

In the preferred embodiment, the seal retention assembly includes an upper spring carrier and a lower spring carrier. The upper spring carrier and lower spring carrier are located between the upper and lower seal members; a spring is utilized for urging the upper and lower spring carriers apart, the upper spring carrier being urged toward the upper seal member and away from the lower seal member, the lower spring carrier being urged toward the lower seal member and away from the upper seal member; and, fasteners are used for connecting the upper seal member to the lower spring carrier and for connecting the lower seal member to the upper spring carrier so that the upper and lower seal members are urged toward each other.

Use of the flexible seal apparatus that is made in accordance with this invention eliminates the need for extensive machining of the interfacing surfaces of the leading portion of the hydrofoil and the flap. That is, since the spring-biased connection between the upper and lower seal members allows some movement of the surfaces away from each other, then any contour irregularities that present themselves when the flaps are operated can be slidably accommodated by the flexible spring-biased seal members with no binding effect on the flap's movement.

Since the seal members are not integrally formed with the surface of the leading portion of the hydrofoil, they can be positioned after the hydrofoil flaps have been installed and tested. Furthermore, the seal apparatus can be readily removed and replaced; avoiding the need for cutting and rewelding the leading portion of the hydrofoil flap.

DETAILED DESCRIPTION

Figure 1:
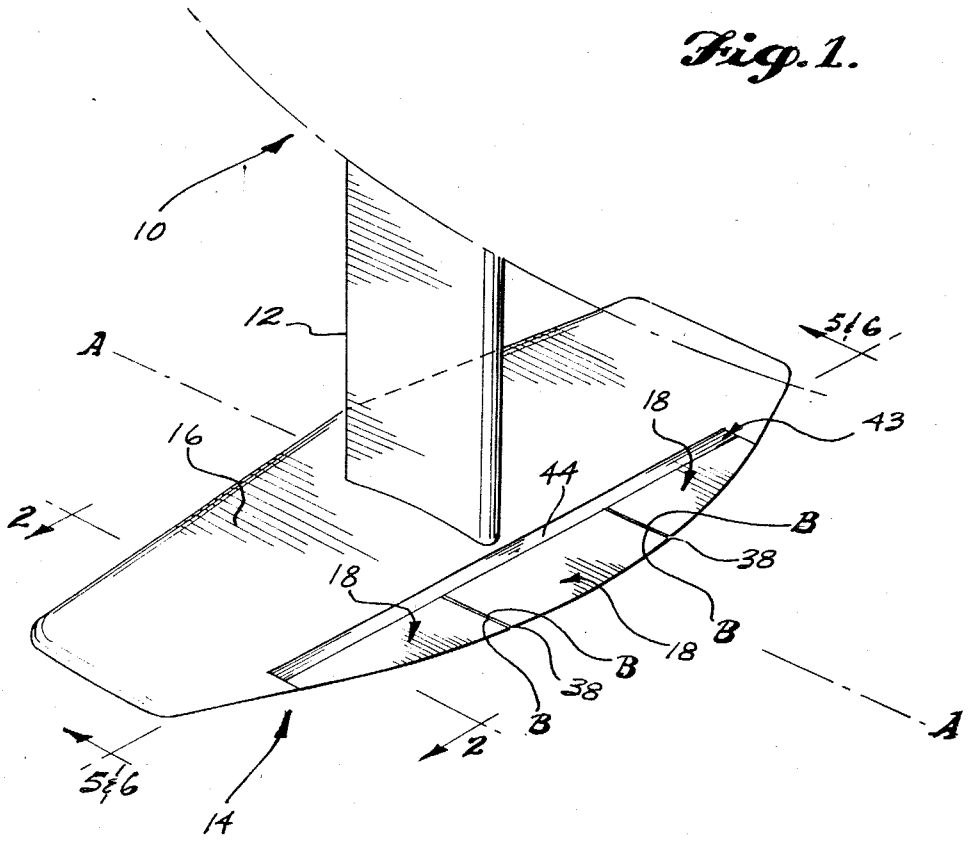
FIG. 1 is an isometric view of a hydrofoil mounted on a strut near the bow portion of a hydrofoil craft, with the seal configured in accordance with this invention in place.

Referring to FIG. 1, a substantially planar hydrofoil 14 is orthogonally mounted to a strut 12 that extends downwardly from the hull portion 10 of a hydrofoil craft. The hydrofoil is generally composed of a leading portion 16 which is contoured to provide hydrodynamic lift as the hydrofoil craft moves through the water. Flaps 18 are pivotally attached to the trailing edge of the leading portion of the hydrofoil. Upward and downward movement of the trailing edges of the flaps causes changes in the attitude of the craft as it moves through the water. Movement of the flaps is controlled by conventional control and linkage means which are not shown. Spanning the space between the trailing edge of the leading portion of the hydrofoil and the leading edge of the hydrofoil flap, is a seal assembly 43 made in accordance with this invention.

With particular reference to FIGS. 2 through 5, details of the preferred embodiment of the invention along with its operating environment can best be described. The leading portion of the hydrofoil 16 (FIG. 2) has an upper surface 30 and a lower surface 32, which are joined together by a substantially flat trailing edge 22 that extends between the rear edges of upper and lower surfaces 30 and 32. Upper and lower mounting ledges 24 and 26, respectively, are formed in (or fixed to) the outermost surface 23 of the trailing edge 22. The upper mounting ledge 24 is located proximal to the junction of the trailing edge 22 and the upper surface 30 of the leading portion of the hydrofoil, being located slightly below the upper surface 30 of hydrofoil 16. Mounting ledge 24 is formed by an upwardly projecting lip 27, and a groove 28 formed between lip 27 and the trailing edge 22. The lower mounting ledge 26 is formed as a mirror image of the upper ledge 24 and has downwardly projecting lip 27' and corresponding groove 28'.

At spaced-apart locations along the length of the trailing edge 22, conventionally configured hinges 38 (shown in phantom lines) extend outwardly from the leading portion of hydrofoil 16 to provide a hinge axis 40 about which the flaps 18 are pivotally mounted by any conventional method. As is also illustrated by phantom lines in FIG. 2, each flap 18 includes an upper surface 34 and a lower surface 36 which are joined together by a smoothly contoured (e.g., a semicircular-shaped) leading edge 37. The trailing edges of the upper surface 34 and the lower surface 36 gradually converge to meet at the trailing edge of the flap (not shown).

A seal assembly 43 that is constructed in accordance with this invention includes three primary components: an upper seal member 44, which spans the gap between the hydrofoil upper surface 30 and flap upper surface 34; a lower seal 46, which spans the the gap between hydrofoil lower surface 32 and flap lower surface 36; and a retainer assembly 53, which interconnects upper and lower seal members 44 and 46 with hydrofoil 16 and causes the upper and lower seal members 44 and 46 to remain in contact with the upper and lower surfaces of the hydrofoil throughout the full deflection range of flap 18.

Figure 2:
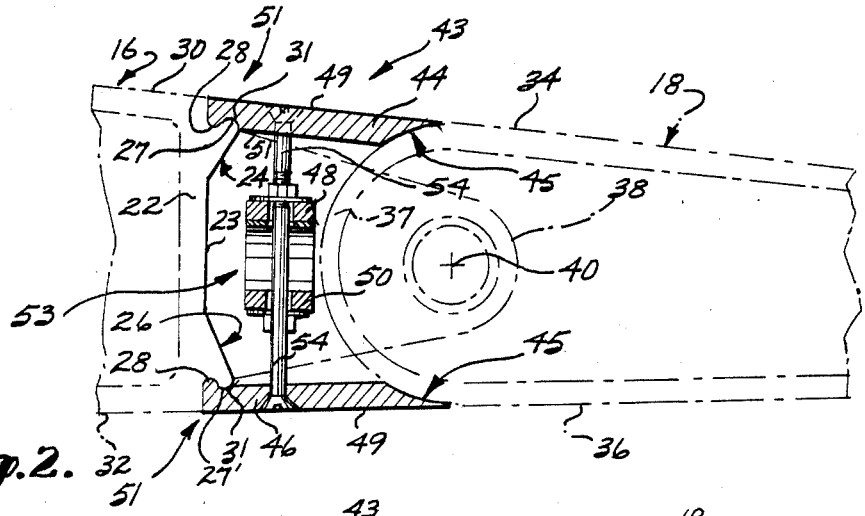
FIG. 2 is a cross-sectional view of the seal of FIG. 1 with the hydrofoil flap shown in the neutral position.
Figure 3:
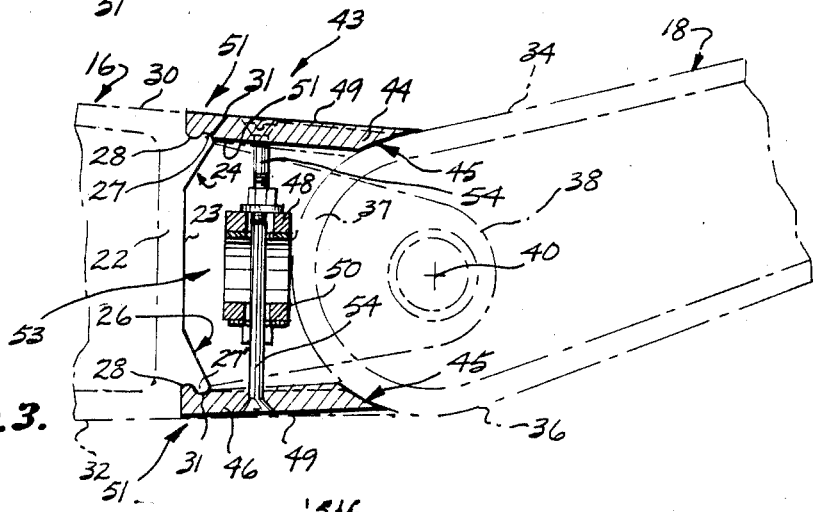
FIG. 3 is a cross-sectional view of the seal of FIG. 1 with the hydrofoil flap shown in the raised position.
Figure 4:
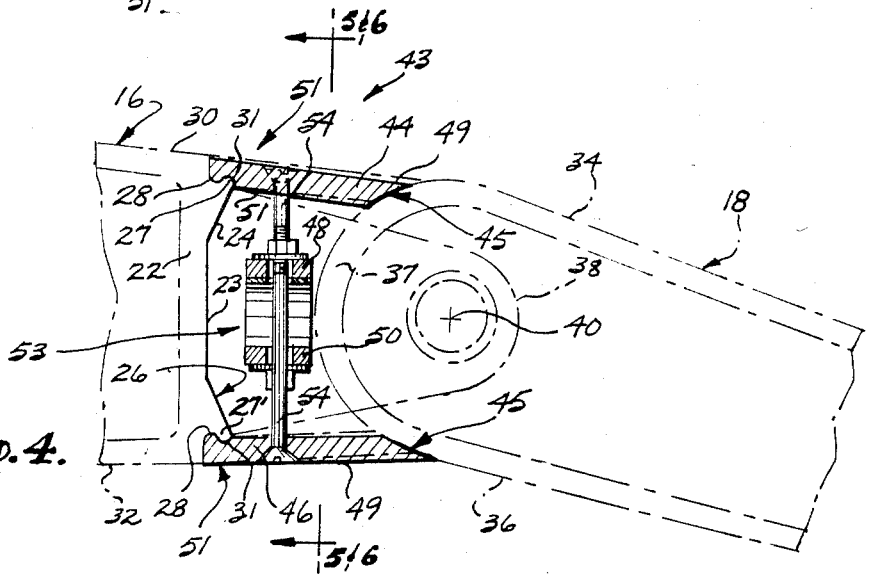
FIG. 4 is a cross-sectional view of the seal of FIG. 1 with the hydrofoil flap shown in the lowered position.

As is shown in FIGS. 2–4, upper seal member 44 and lower seal member 46 exhibit substantially identical geometry. In this regard, both upper seal member 44 and lower seal member 46 are basically rectangular in cross section. Extending along the forward edge 51 of upper seal member 44 and lower seal member 46 is a groove 31 that is dimensioned and contoured so that the forward edges 51 of the upper and lower seal members nest in grooves 28 in the upper and lower mounting ledges 24 and 26 while the projecting lips 27 and 27' of upper and lower mounting ledges 24 and 26 extend into and contact with the surfaces of grooves 31 in upper and lower seal members 44 and 46. The trailing edges 45 of both upper and lower seal members 44 and 46 are arcuately contoured to match the radius of leading edge 37 of flap 18. Thus, as is shown in FIG. 2, when flap 18 is in the neutral (undeflected) position, the relatively flat outermost surface 49 of upper flap seal 44 is substantially coplanar with upper surface 30 of the leading portion of the hydrofoil 16 and upper surface 34 of hydrofoil flap 18. Similarly, the relatively flat outermost surface 49 of lower flap seal member 46 is substantially coplanar with lower surface 32 of the leading portion of the hydrofoil 16 and lower surface 36 of flap 18.

In the currently preferred embodiments of the invention, upper seal member 44 and lower seal 46 preferably are formed of a composite material that includes high-strength fibers (e.g., nylon) embedded in a resin matrix. Constructing upper seal member 44 and lower seal member 46 from such a material is advantageous in that the material can easily be machined by hand when the seal members are installed between the leading portion of the hydrofoil 16 and flap 18. Machining upper and lower seal members 44 and 46 when the seal members are fitted to the hydrofoil ensures optimum performance in that relatively close tolerance fits can be achieved. The composite materials can be fabricated so that the seal members will exhibit a relatively high degree of elasticity as compared to seal members constructed of metal.

As shall be described hereinafter, retainer assembly 53 urges upper seal member 44 and lower seal member 46 toward one another so that the forward edge 51 of each seal member is maintained in the described nested position, and the trailing edge 45 of upper and lower seal members 44 and 46 contact the outer surface of flap 18. In this regard, as illustrated by FIG. 3, when flap 18 is rotated upwardly about hinge axis 40, trailing edge 45 of upper seal member 44 slides along upper surface 34 of flap 18 and trailing edge 45 of lower seal member 46 slides along the curved leading edge 37 of flap 18. As is shown in FIG. 4, when flap 18 is deflected downwardly, trailing edge 45 of upper seal member 44 slides along the curved leading edge 37 of flap 18 and the trailing edge 45 of lower seal member 46 slides along lower surface 36 of flap 18.

Referring now to FIGS. 1–5, retainer assembly 53 consists of a spaced-apart upper spring carrier 48 and a lower spring carrier 50 that are essentially rectangular bars that are parallel to one another and extend along the length of the hydrofoil between the upper and lower seal member 44 and 46. The upper spring carrier 48 is secured to the lower seal member 46 by a plurality of fasteners 54 at spaced apart locations along the length of the upper spring carrier 48. In the depicted embodiment, fasteners 54 are conventional bolts which include countersunk heads 56 that are embedded within the surface of the lower seal member 46. A smooth shank portion extends from seal member 46 through apertures 68 that are formed in the lower spring carrier 50 in alignment with the fasteners 54. The end portion of the shank 58 is threaded and passes through apertures 69 in the upper spring carrier that are also aligned with the fasteners 54. The threaded end 58 that protrudes from the upper spring carrier 48 passes through washer 62 and engages nut 60. The lower spring carrier 50 is secured to the upper seal member 44 by a plurality of fasteners 54' in a manner substantially similar to the way the upper spring carrier was connected to the lower seal member. That is, fasteners 54', having countersunk heads 56' embedded within the surface of the upper seal member 44, extend through apertures 69 in the upper spring carrier 48 with the threaded ends 58' that extend through apertures 68 in the lower seal members being engaged by a nut and washer 60', 62' respectively.

Between the upper spring carrier 48 and the lower spring carrier 50, resides a spring 52. Spring 52 is an elongate wave-shaped strip of spring steel having apertures 57 along its length that are aligned with, and allow passage of, bolts 54 and 54'. Apertures 72 in hinges 38 provide for passage of the spring 52 and retention assembly through the hinges.

The effect of spring 52 is to urge upper spring carrier 48 and lower spring carrier 50 apart. Due to the above-described fastening, as the upper and lower spring carriers are urged apart, the upper seal member 44 and the lower seal member 46 are drawn together. Specifically, spring 52 is configured and arranged so that when fasteners 54 and 54' are secured to their respective spring carriers, spring 52 will be in compression with the reactive spring force acting continuously against the upper and lower spring carriers. The spring force on the upper spring carrier 48 is transferred to fastener 54 which in turn pulls at its countersunk head 56 upon the lower seal member 46 toward the spring 52. Conversely, the spring force communicated to lower spring carrier 50 is transferred to the fasteners 54' whose countersunk heads 56' pull against the upper seal member 44 toward the spring 52. The effect of the transferred spring force causing the upper and lower seal members to be urged together acts to maintain the nesting connection at the forward edges 51 of the upper and lower seal members, and also maintain the trailing edges 45 of the seal members in sliding contact with the surfaces of the flap 18.

Figure 6:
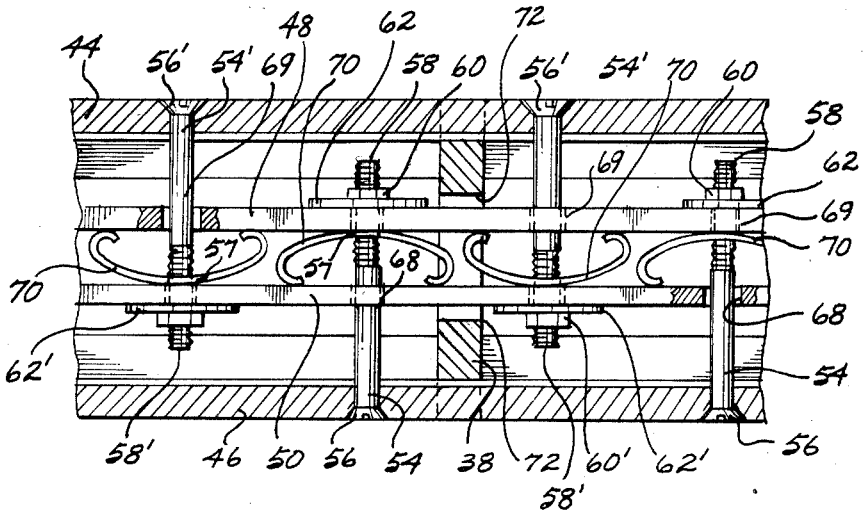
FIG. 6 is a cross-sectional view of an alternative embodiment of the invention taken along lines 6—6 of FIG. 1.
Figure 5:
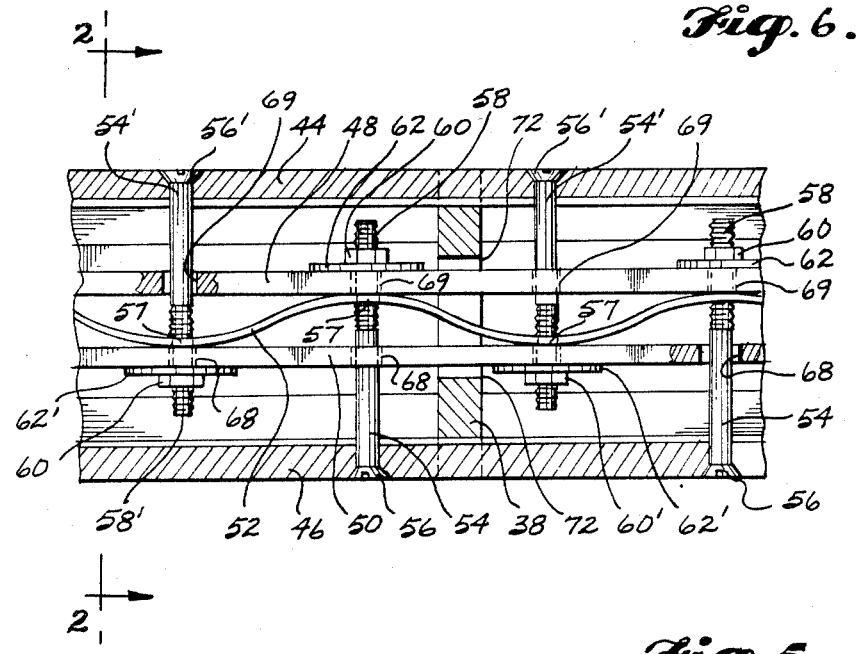
FIG. 5 is a cross-sectional view of the seal of FIG. 1 taken along lines 5—5 of FIG. 1.

It can be appreciated that an alternative embodiment, such as shown in FIG. 6 can utilize individual pieces of spring steel 70 incorporated at each particular fastener, or utilize a coil spring (not shown) concentrically positioned between the spring carriers 48 and surrounding at least a portion of bolts 54 and 54'.

Since the trailing edges 45 of the seal members can move in response to movement of the leading edge 37 of the hydrofoil flap, it is not necessary to leave an operating clearance between those edges and the upper and lower surfaces of the hydrofoil flap. The retainer assembly 53 will cause the trailing edges 45 of the seal members to be continuously pressed against the surfaces of the hydrofoil flap. Thus, as shown in FIGS. 3 and 4, the trailing edge 45 of the seal members will "ride" the contour of the leading edge 37 of the hydrofoil flap as the trailing edge of the flap is actuated upwardly (FIG. 3) or downwardly (FIG. 4). Any irregularities in the contour of the leading edge of the hydrofoil will not affect the performance of the seal members since they can slide over (as opposed to binding against) such irregularities.

It can be appreciated that the independent nature of the seal apparatus allows it to be readily removed and replaced without affecting the overall operation of the hydrofoil and the hydrofoil flap. This capability allows the seal to be fitted after the flaps have been completely installed and tested.

With reference to FIG. 1, a further advantage of the invention will now be described. Specifically, under normal operating conditions, the hydrofoil has a tendency to bend or flex about its longitudinal A—A in FIG. 1. The flaps 18, which are not integrally formed with the leading portion of the hydrofoil 16, are essentially independent structures directly connected to the leading portion of the hydrofoil only at their longitudinal end points B, which are located at the hinges 38. Thus, as the leading portion 16 of the hydrofoil bends about its longitudinal axis, the flaps 18 will also be forced to bend due to forces communicated through hinges 38. Because the structure of leading portion 16 of the hydrofoil differs from that of hydrofoil flap 18, the degree of curvature induced in both elements when bending moments are present will not be identical. However, since the area between leading portion 16 and flap 18 is spanned by the relatively elastic seal members 44 and 46, a substantially smooth contour can be maintained between the upper and lower surfaces of the hydrofoil since the seal members are adaptable to these differences in curvature. Conventional rigid surface extensions of the leading portion do not readily accommodate these bending forces and binding generally occurs unless large operational gaps (with a detrimental effect on hydrodynamic performance) are formed between the extensions and the flap.

While the invention has been described with reference to a preferred embodiment, it is clearly understood by those skilled in the art that the invention is not limited thereto. Rather, the scope of the invention is to be interpreted only in conjunction with the appended claims.

The embodiments of the invention in which an exclusive property or privilege is claimed are defined as follows:

1. Apparatus for sealing the surface spaces between the leading portion of a hydrofoil and its movable trailing flap, wherein the leading portion of the hydrofoil has upper and lower surfaces and a trailing edge, the hydrofoil flap also having an upper and lower surface and the trailing edge, the flap also having a leading edge spaced apart from the trailing edge of the leading portion of the hydrofoil, said apparatus comprising:

a. an upper seal member spanning the space between the upper surface of the leading portion of the hydrofoil and the upper surface of the flap;

b. a lower seal member spanning the space between the lower surface of the leading portion of the hydrofoil and the lower surface of the flap; and, c. seal retention means positioned between the upper seal member and the lower seal member and interconnected between those members for ensuring continuous contact between the upper seal member and the upper surfaces of the leading portion of the hydrofoil and the flap, and for ensuring continuous contact between the lower seal member and the lower surfaces of the leading portion of the hydrofoil and the flap.

2. The apparatus of claim 1 wherein each seal member has a forward edge abutting the trailing edge of the leading portion of the hydrofoil, each seal member also having a trailing edge in slidable contact with the leading portion of the flap.

3. The apparatus of claim 2 wherein the seal retention means includes:

a. an upper spring carrier and a lower spring carrier, the upper spring carrier and the lower spring carrier located beween the upper and lower seal members;

b. spring means for urging the upper and lower spring carriers apart, the upper spring carrier being urged toward the upper seal member and away from the lower seal member, the lower spring carrier being urged toward the lower seal member and away from the upper seal members; and, c. connector means for connecting the upper seal member to the lower spring carrier and for connecting the lower seal member to the upper spring carrier so that the upper and lower seal members are urged toward each other.

4. The apparatus of claim 3 wherein the leading edge of the flap is a curved surface joining the upper and lower surfaces of the flap, the curved surface being configured to present a convex shaped leading edge of the hydrofoil flap; the trailing edges of the upper and lower seal members that are in slidable contact with the leading portion of the flap being arcuately contoured for contact with said convex shaped leading edge.

5. The apparatus of claim 4 wherein the connector means comprises:

a. a plurality of upper fasteners having one end secured to the upper seal member and another end secured to said lower spring carrier; and, b. a plurality of lower fasteners having one end secured to the lower seal member and another end secured to the upper spring carrier, the upper and lower fasteners being positioned at spaced-apart locations along the length of the apparatus.

6. The apparatus of claim 5 wherein the spring means comprises a spring located between the upper and lower spring carriers, the spring being in a compressed state when the upper and lower seal fasteners are secured in place.

7. The apparatus of claim 6 wherein the spring is a substantially thin strip extending substantially along the length of the apparatus, the spring being wave-shaped in longitudinal cross section.

8. The apparatus of claim 6 wherein the centers of the upper and lower seal fasteners along with the longitudinal centerline of the spring means and the longitudinal centerline of the upper and lower spring carriers are all located substantially in one plane, the upper spring carrier having a plurality of apertures aligned with the upper fasteners, the apertures being configured and arranged so that the upper fasteners pass through the upper spring carrier without restraining movement of the upper spring carrier along the plane, the lower spring carrier also having a plurality of apertures aligned with the lower fasteners, the apertures in the lower spring carrier being configured and arranged so that the lower surface fasteners pass through the lower spring carrier without restraining movement of the lower spring carrier member along the plane.

9. The apparatus of claim 3 wherein said trailing edge of the leading portion of the hydrofoil includes upper and lower protrusions, said upper and lower protrusions having an outwardly projecting lip and an adjacent groove; and wherein the forward edge of the upper and lower seal members include a lip and groove formed therein, the lips of the seal members nesting in the grooves of the corresponding upper and lower protrusions and the lips of the protrusions nesting in the grooves of the corresponding upper and lower seal members.

* * * * *

UNITED STATES PATENT AND TRADEMARK OFFICE

CERTIFICATE OF CORRECTION

PATENT NO. : 4,577,579

DATED : March 25, 1986

INVENTOR(S) : John W. Williams

It is certified that error appears in the above-identified patent and that said Letters Patent is hereby corrected as shown below:

Column 1, line 42, after "surface" insert --extensions.--

Column 3, line 35, after "surface 36" add a comma (,)

Column 3, line 44, delete "the" (second occurrence)

Column 4, line 45, "member" should be --members--

Column 4, line 47, "spaced apart" should be --spaced-apart--

Column 5, line 34, after "48 and" insert --50 and--

Column 5, line 61, after "longitudinal" insert --axis--

Signed and Sealed this

Twenty-eighth Day of October, 1986

[SEAL]

*Attest:*

DONALD J. QUIGG

*Attesting Officer* *Commissioner of Patents and Trademarks*